US006375116B1

(12) United States Patent
Askins et al.

(10) Patent No.: US 6,375,116 B1
(45) Date of Patent: Apr. 23, 2002

(54) CORE END PLUG FOR SHEET ROLL MATERIAL

(75) Inventors: Paul Askins; Vincent Dethier; Jeffrey Mock, all of Rochester, NY (US)

(73) Assignee: A.B. Dick Company, Niles, IL (US)

( * ) Notice: Subject to any disclaimer, the term of this patent is extended or adjusted under 35 U.S.C. 154(b) by 7 days.

(21) Appl. No.: 09/669,820

(22) Filed: Sep. 26, 2000

(51) Int. Cl.[7] ..... B65H 75/14

(52) U.S. Cl. ..... 242/609; 242/609.4; 242/612; 242/599.2; 242/599.4

(58) Field of Search ..... 242/609, 609.4, 242/612, 599.2, 599.4

(56) References Cited

U.S. PATENT DOCUMENTS 2,320,068 A * 5/1943 Crebbs ..... 242/599.4

* cited by examiner

*Primary Examiner*—John Q. Nguyen

(74) *Attorney, Agent, or Firm*—Pearne & Gordon LLP

(57) ABSTRACT

A core end plug for mounting a roll of sheet material on a shaft. The plug comprises a cylindrical band of stiffly flexible plastic material having ends defining a longitudinal gap therein. A plurality of radial webs extend inwardly from the band. A pair of the webs are opposite each other and are provided with first and second elongated apertures which define identical acute angles to the diameter of the band. A third web defines third and fourth elongated apertures along a common major axis perpendicular to the diameter. A band is fitted into each end of a roll core and a mounting plate is inserted into each core end plug. A mounting shaft extends through central apertures in the mounting plates and through the fourth aperture in the third web. Pins in the mounting plate are received in the first and second elongated apertures.

15 Claims, 4 Drawing Sheets

FIG. 1
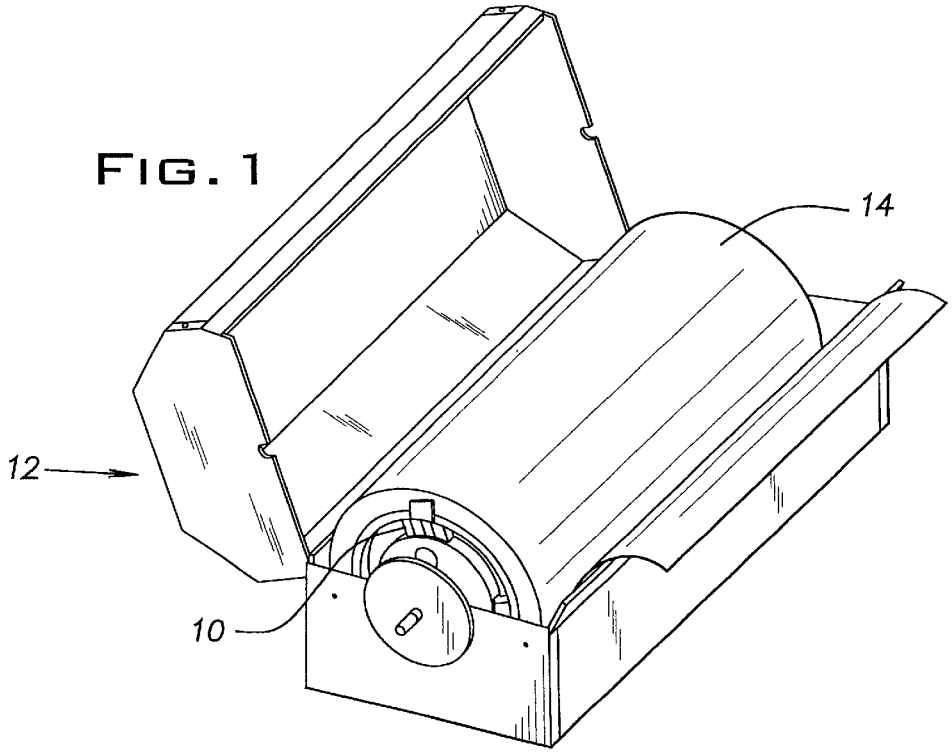
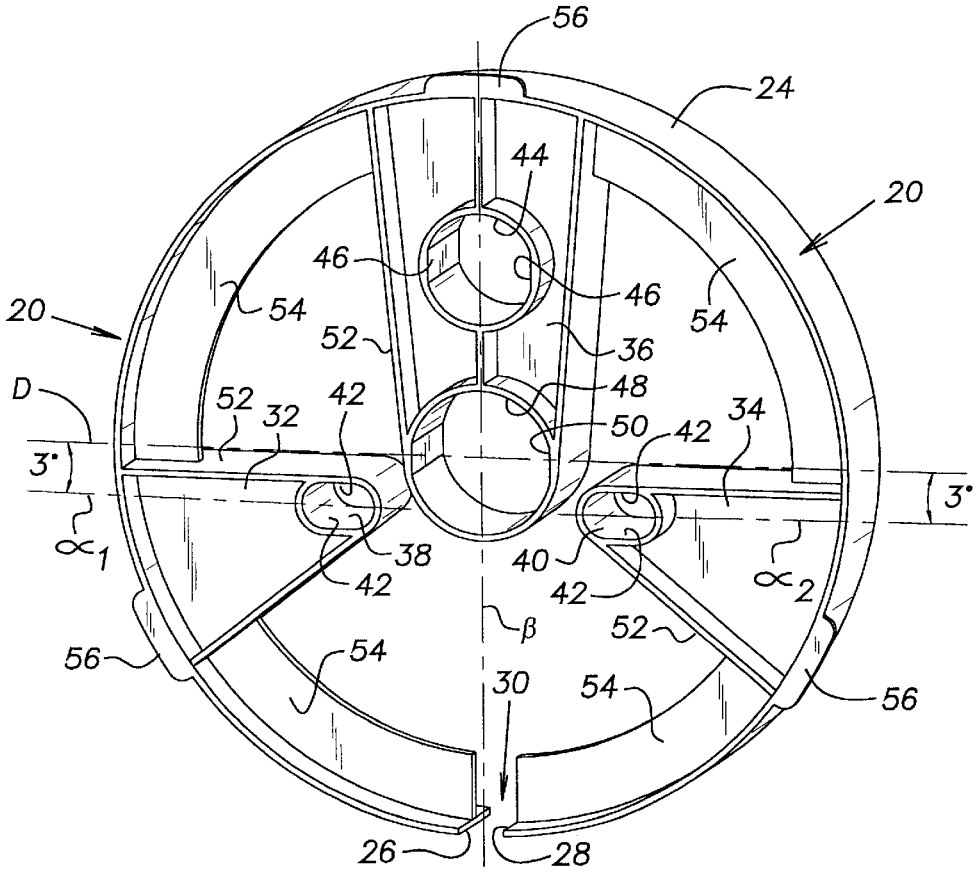
FIG. 3

CORE END PLUG FOR SHEET ROLL MATERIAL

This invention relates to core end plugs and, more particularly, end plugs for mounting rolls of photosensitive material in graphic art devices such as platemakers.

BACKGROUND OF THE INVENTION

Photosensitive materials are typically supplied in roll form by winding the photosensitive material onto a core. The core is disposed of once all the photosensitive material has been used. Paperboard is the most common material for the core because of its low cost. The interface between the roll of photosensitive material and most devices, which expose the photosensitive material, is the inside diameter of the paperboard core. On many devices that expose photosensitive material, such as platemakers, the position of the photosensitive material must be accurately controlled to allow the image to be accurately placed on the material. This requires a tight connection between the paperboard core and its mounting within the device. A loose connection would allow movement between the core and its mounting and therefore, poor registration between the image and the material. A tight connection becomes difficult because of manufacturing variations in the paperboard core. The inside diameter of the core can vary by as much as 1.2 mm. To accommodate this variation, the mounting in the device must either be oversized, adjustable in size, or tapered in size. These options present difficulties. An oversized mounting makes it difficult to install and remove because of the force required to press the mounting into the core. An adjustable mounting adds complexity and cost to the device and is prone to user error. A tapered fit changes the axial position of the roll.

SUMMARY OF THE INVENTION

This invention provides an interface between a photosensitive material cassette and the paperboard core of the roll mounted therein. According to this invention, a core end plug comprises a cylindrical band of stiffly flexible plastic material having ends defining a longitudinal gap therein. A plurality of radial webs extend inwardly from the band. A pair of the webs are opposite each other and are provided with first and second elongated apertures having parallel longitudinal sides defining identical acute angles of about 3° to a first diameter of the band. A third web defines third and fourth elongated apertures having parallel longitudinal sides and having a common major axis aligned with a second diameter of the band which is perpendicular to the first diameter.

A core end plug is easily fitted into each end of a roll core and may be cemented therein to be disposed with the core. Radially extending tabs are provided on the outer edges of each band to butt against the ends of the roll of material.

A mounting plate is inserted into to each core end plug. Each mounting plate has first and second pins equidistantly spaced from a central axis of the plate and are respectively received in the first and second apertures of the opposite pair of webs. A third pin on the mounting plate is received in the third aperture in the third web.

A mounting shaft extends through a central aperture in each mounting plate and through the fourth aperture in the third web. The axis of the shaft remains colinear with the axis of the core for all degrees of flexure of the band to fit into the core. The angled slots or apertures in the first and second webs shift the position of the first and second pins of the mounting plate relative to its end plug as the diameter of the band is varied by flexure so that the axis of the mounting shaft is always coaxial with the axis of the core. This prevents wobble of the roll while the sheet material is being pulled from the roll.

BRIEF DESCRIPTION OF THE DRAWINGS

FIG. 1 is a perspective view of a mounting assembly positioned in a cassette;

FIG. 3 is a perspective view of an end plug according to the invention;

DETAILED DESCRIPTION OF THE INVENTION

Figure 2:
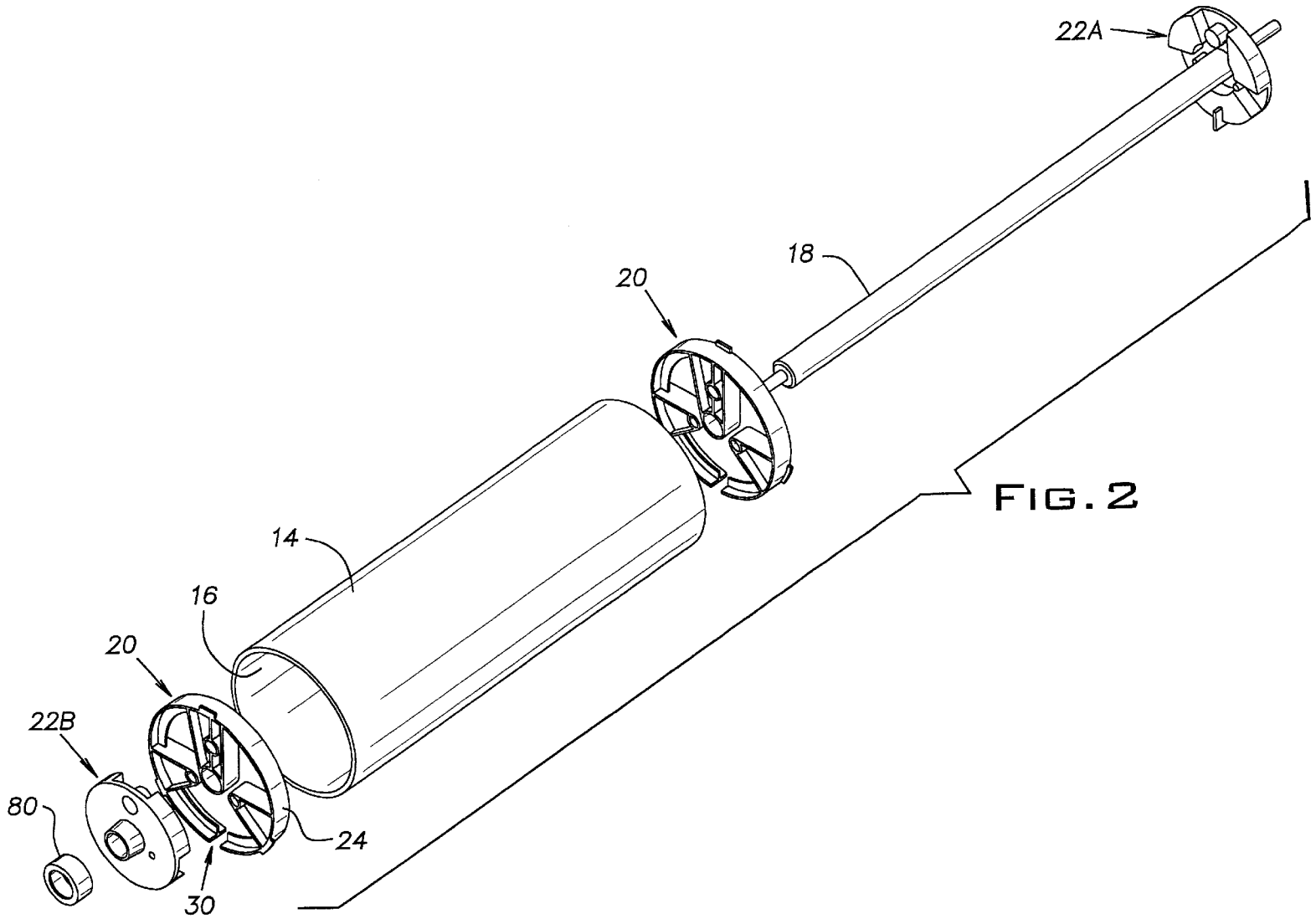
FIG. 2 is an exploded, perspective view of a mounting assembly according to the invention.
Figure 4:
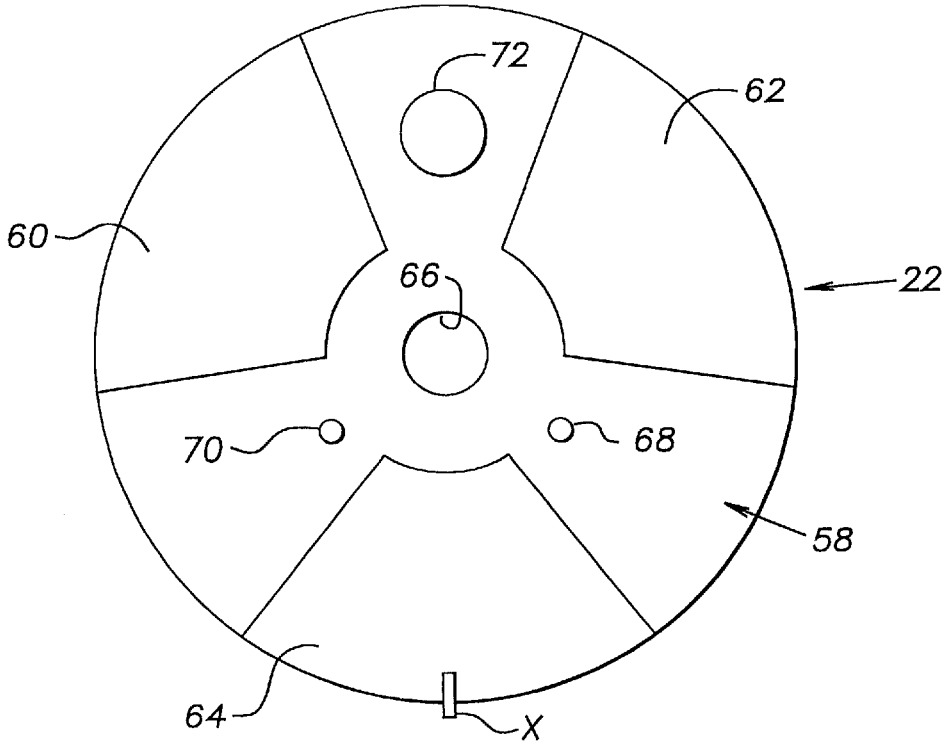
FIG. 4 is an elevational view of a mounting plate according to the invention.

Referring now to the drawings, there is illustrated a mounting assembly 10 arranged in a roll cassette 12 which is used to feed photosensitive sheet material to a platemaker.

The mounting assembly 10 supports a roll of photosensitive sheet material 14 wrapped on a paperboard core 16. A mounting shaft 18 extends axially through the core 16. An end plug 20 and a mounting plate 22 are provided at each end of the shaft 18.

Each end plug 20 comprises a cylindrical band 24 of stiffly flexible plastic material having ends 26 and 28 which define a longitudinal gap 30 therein. A plurality of radial webs 32, 34, and 36 extend inwardly from the band 24, and the webs 32 and 34 are provided with elongated apertures 38 and 40 having parallel longitudinal sides 42 and major axes $\alpha_1$ and $\alpha_2$ which define acute angles of about 3° with a first diameter D of the end plug 20. The web 36 is provided with a third elongated aperture 44 having parallel elongated sides 46 and a major axis $\beta$ which is perpendicular to the diameter D and which is colinear with another diameter of the plug 20. The web 36 is further provided with a fourth elongated aperture 48 having parallel elongated sides 50 and a major axis which is colinear with the major axis $\beta$ and, therefore, the other diameter of the plug 20.

Each web 32, 34 and 36 is defined by stiffening sides 52 having an axial extent corresponding to the axial extent of the band 24. A stiffing rib 54 extends radially inwardly from the band 24 between the webs 32, 34 and 36 and coplanar thereto.

The plug 20 is preferably injection molded from a suitable thermoplastic, and since it is a low cost item, it may be bonded to the paperboard core to be disposed therewith. The end plugs 20 are constructed so that they have an initial outside band diameter which is slightly larger than the maximum inside diameter of a core 16 so that the gap 30 is narrowed and the band 24 assumes a smaller diameter when the plugs 20 are inserted and cemented within the open ends of the core 16. A plurality of tabs 56 extend radially outwardly from the band 24 and engage the ends of the core 16 to ensure that the plugs 20 are properly seated in the core 16.

The shaft 18 is mounted through the aperture 48 in each plug 20 and a mounting plate 22 is mounted on each protruding end of the shaft 18. Each mounting plate 22 may be metal or plastic and comprises a base 58 having a plurality of raised sectors 60, 62, and 64. Each mounting plate 22 has a central cylindrical opening 66 which receives the end of the shaft 18 with a close fit. The mounting plate 22A is permanently fixed to the shaft 18, and the mounting plate 22B is axially advanced on the shaft 18 until the base 58 engages the stiffening sides 52 of the plug 20. The sectors 60, 62 and 64 and the tab X aid in aligning the pins 68, 70 and 72 of the mounting plate 22 to the apertures 38, 40 and 44 of the plug 20. A plurality of cylindrical pins 68, 70, and 72 are respectively received in the apertures 38, 40, and 44. The diameters of the pins 68 and 70 correspond to the distance between the parallel sides 42 of the apertures 38 and 40 and the diameter of the pin 72 corresponds to the distance between the sides 46 of the aperture 44. The shaft 18 extends through the aperture 48 and has a diameter corresponding to the distance between the parallel elongated sides 50.

Flexure of the band 24 to accommodate the inside diameter of the core reduces the diameter of the band 24 but the apertures 38 and 40 ensure that the center of the roll remains at the center of the band during flexure. This may be more readily apparent from FIG. 5. Actual flexure of the band 24 is usually no more than several millimeters. The flexure illustrated in FIG. 5 is, therefore, greatly exaggerated to demonstrate this feature of the invention.

Figure 5:
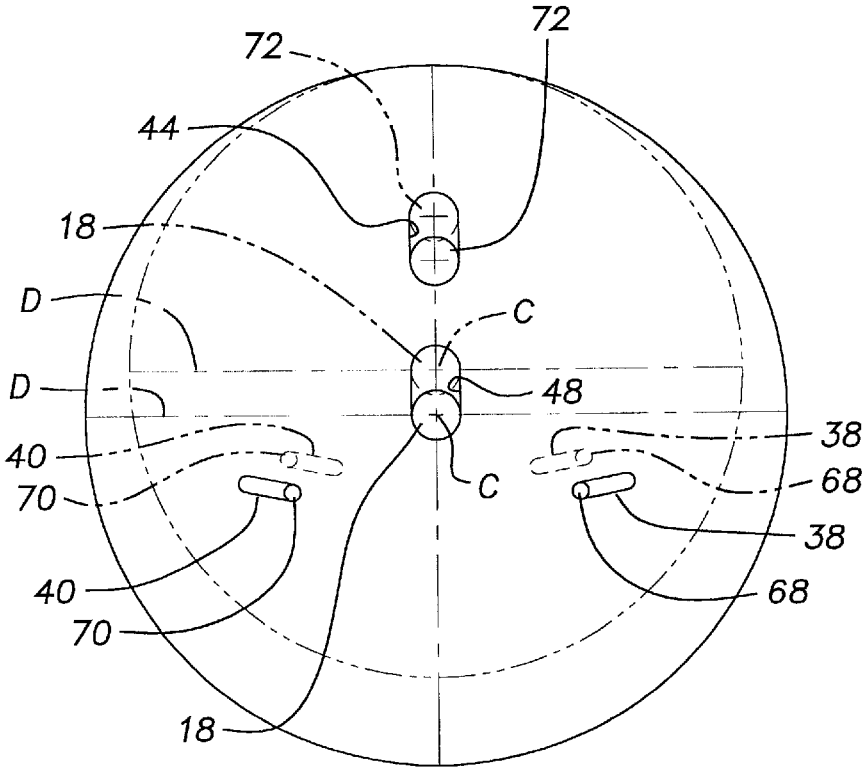
FIG. 5 is a schematic representation of the roll-centering feature of the invention.

In FIG. 5, it is assumed that the diameter of the band 24 is reduced from its solid outline position to its phantom outline position to insert the plug 20 into the core 16. This flexure moves the apertures 38 and 40 from their solid outline position to their phantom outline position to reposition the pins 68, 70 and 72 as shown. Repositioning the pins 68, 70 and 72 also repositions the center C of the shaft 18 to position the shaft 18 at the center of the reduced diameter band 24 and therefore, at the center of the core 16.

After the core is positioned on the mounting assembly, the mounting plate 22B is pushed toward the mounting plate 22A to remove any clearance. Then a locking nut 80, which was previously loosely placed on the end portion of the mounting plate 22B, is tightened. The assembly is placed in the cassette 12 as is shown in FIG. 1.

Figure 6:
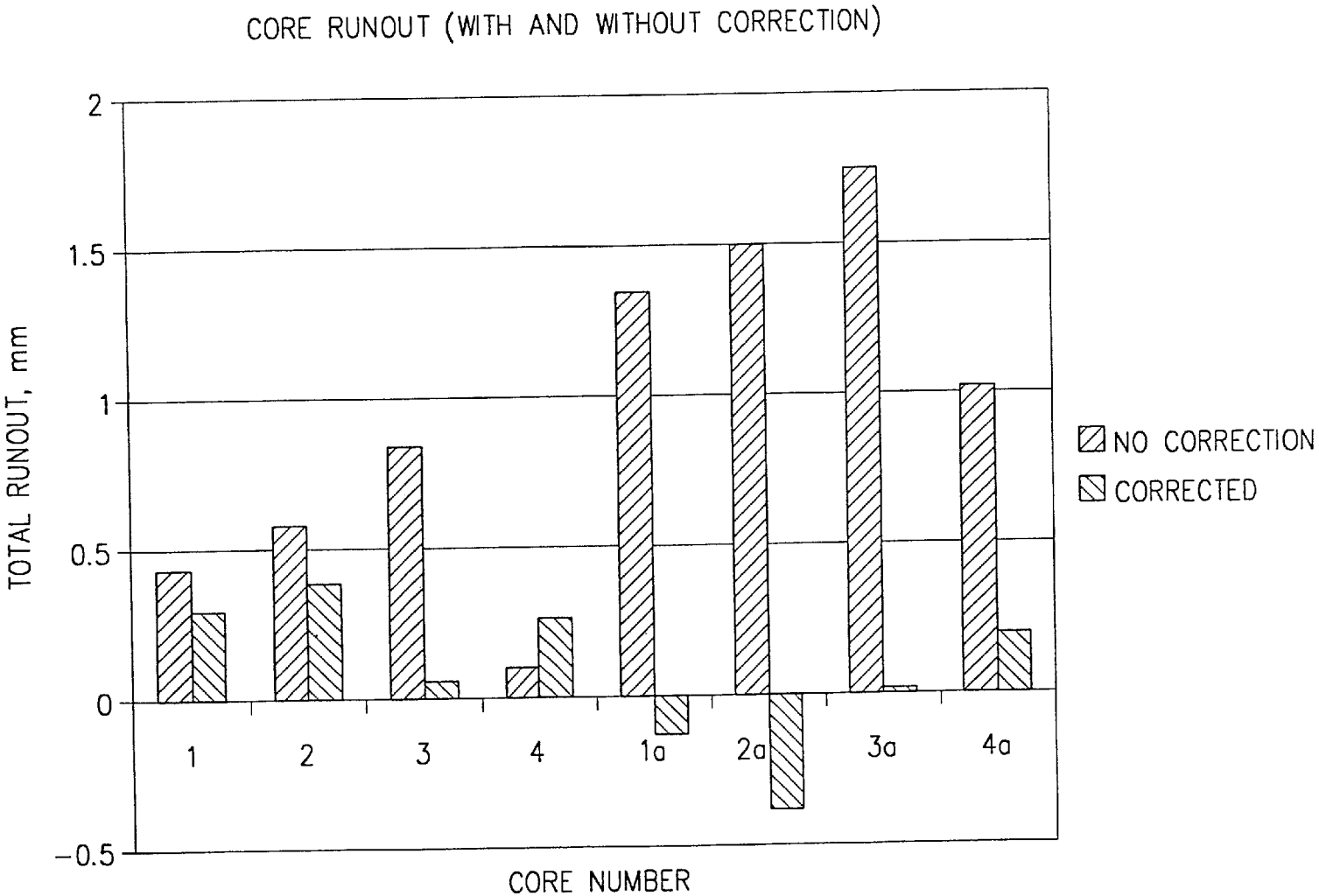
FIG. 6 is a chart showing corrected and uncorrected runout of various cores.

FIG. 6 compares roll center eccentricity or runout of a roll according to this invention with a prior art loose fit mounting arrangement (no correction). By minimizing runout, the position of the photosensitive material is accurately controlled to allow the image to be accurately placed on the material.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A core end plug for mounting a roll of sheet material on a shaft comprising a cylindrical band of stiffly flexible material having ends defining a longitudinal gap therein, a plurality of radial webs extending inwardly from said band, a substantially opposite pair of said webs each defining an elongated aperture having parallel longitudinal sides defining an acute angle to a first diameter of said band, and another of said webs defining a first elongated aperture having parallel longitudinal sides and having a major axis aligned with a second diameter of said band.

2. A core end plug according to claim 1 wherein said first diameter and said second diameter are perpendicular to each other.

3. A core end plug according to claim 2 wherein said second diameter bisects said gap.

4. A core end plug according to claim 1 wherein said another of said webs defines a second elongated aperture having a major axis aligned with said second diameter.

5. A core end plug according to claim 1 wherein said acute angle is about 3°.

6. A core end plug according to claim 1 including radial tabs extending outwardly from an edge of said band.

7. A core end plug according to claim 1 including a reinforcing rib extending inwardly from said band.

8. A mounting assembly for a roll of sheet material wound on a cylindrical core having an inside diameter and a longitudinal axis, said mounting assembly comprising a mounting shaft adapted to extend axially through said core and having a longitudinal axis, an end plug and a mounting plate at each end of said shaft, with one or both of the mounting plates being removably fixed to said shaft at a central axis of said plate so that the axis of said shaft and said central axis are colinear, each end plug comprising a cylindrical band of stiffly flexible material having ends defining a longitudinal gap therein, a plurality of radial webs extending inwardly from said band, a substantially opposite pair of said webs each respectively defining first and second elongated apertures having parallel longitudinal sides defining an acute angle to a first diameter of said band, and another of said webs defining a third elongated aperture having parallel longitudinal sides and having a major axis aligned with a second diameter of said band, said mounting plate having first and second pins equidistantly spaced from said central axis and being respectively received in said first and second apertures, said mounting plate having a third pin extending into said third aperture, each band being received in an open end of said core, and having an initial outside diameter reduced to correspond to the inside diameter of said core by flexure of said band and reduction of the longitudinal gap therein and reduction of an outside diameter thereof, said axis of said shaft, said central axis of said plate and said longitudinal axis of said core being colinear for all reductions of said outside diameter.

9. A mounting assembly according to claim 8 wherein said first diameter and second diameter are perpendicular to each other.

10. A mounting assembly according to claim 8 wherein said second diameter bisects said gap.

11. A mounting assembly according to claim 8 wherein said another of said webs defines a second elongated aperture having a major axis aligned with said second diameter.

12. A mounting assembly according to claim 8 wherein said acute angle is about 3°.

13. A mounting assembly according to claim 8 including radial tabs extending outwardly from an edge of each said band and engaging each said open end of said core or roll of material.

14. A mounting assembly according to claim 13 wherein each band is adhesively secured within each said open end of said core.

15. A mounting assembly according to claim 8 wherein said acute angle is at any angle which maintains colinear axes of mounting plate and end plug for all reductions of outside diameter of end plug.

* * * * *